US006027055A

United States Patent [19]

Doskocil

[11] Patent Number: 6,027,055

[45] Date of Patent: Feb. 22, 2000

[54] BRUSH CHIPPER

[76] Inventor: David Lee Doskocil, 1324 W. Rialto Ave., San Bernardino, Calif. 92410

[21] Appl. No.: 09/014,541

[22] Filed: Jan. 28, 1998

[51] Int. Cl.[7] ..... B02C 18/22

[52] U.S. Cl. ..... 241/55; 241/92; 241/225

[58] Field of Search ..... 241/92, 285.3, 241/222, 225, 55, 56; 144/176

[56] References Cited

U.S. PATENT DOCUMENTS

| | | |
|---|---|---|
| 4,390,132 | 6/1983 | Hutson et al. . |
| 5,005,620 | 4/1991 | Morey . |
| 5,605,291 | 2/1997 | Doskocil . |

OTHER PUBLICATIONS

Copy of three photographs which are of a product from Bandit Industries, Inc., Model No. 90.

*Primary Examiner*—Mark Rosenbaum
*Attorney, Agent, or Firm*—Lyon & Lyon LLP

[57] ABSTRACT

A brush chipper for chipping wood and debris into smaller pieces. The chipper includes a feed hopper for inserting the material, and upper and lower feed rollers that prepare the material for chipping in the main body of the brush chipper by a chipper disc and bed knife. Debris that collects in a chamber below the lower feed roller is vacuumed out into the main chipper body by fan blades attached to the chipper disc. Components of the brush chipper requiring frequent maintenance, including the disc components and bed knives, are easily accessed because of hinges that allow the feed hopper and the upper body of the brush chipper to swing open.

18 Claims, 6 Drawing Sheets

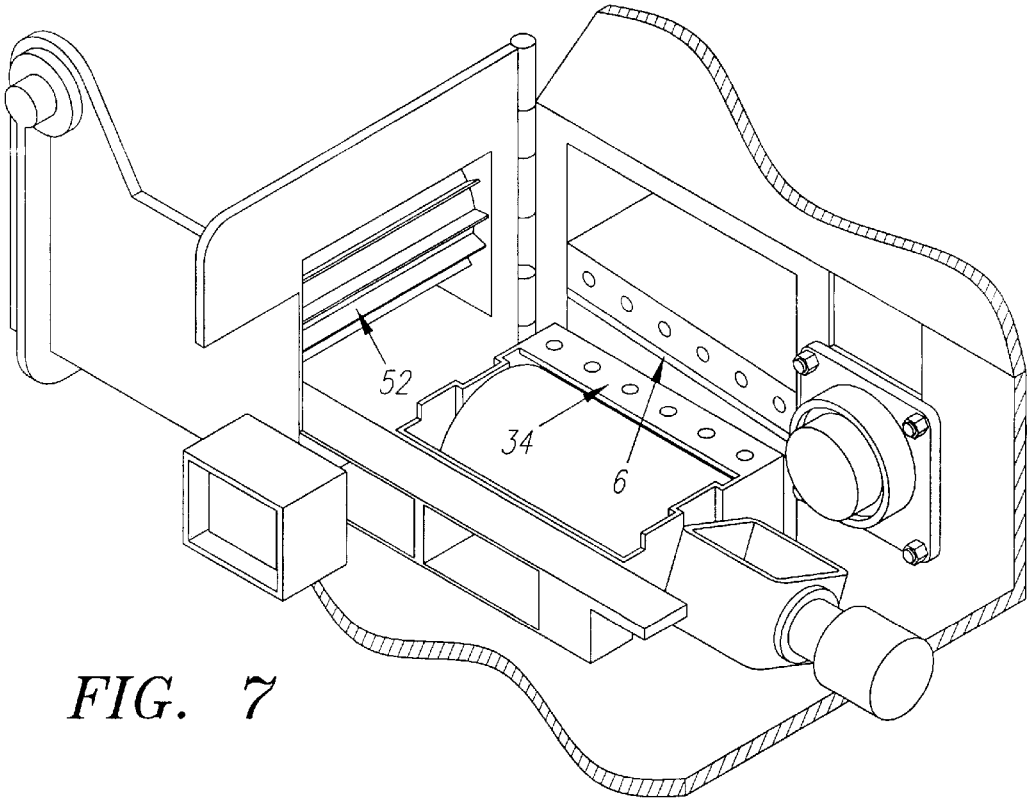
FIG. 7
FIG. 8
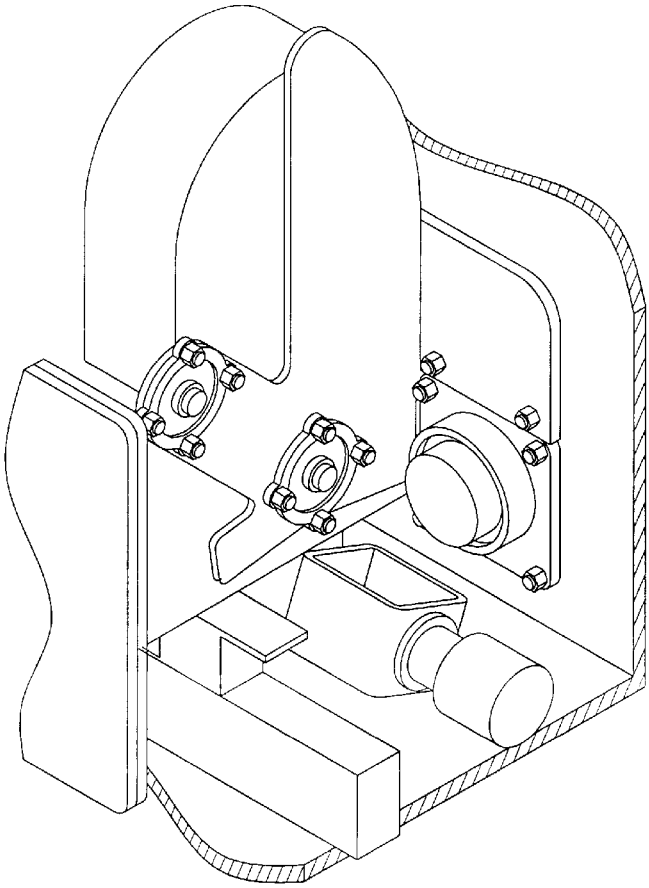

BRUSH CHIPPER

FIELD OF THE INVENTION

The present invention relates to the field of general maintenance.

BACKGROUND OF THE INVENTION

Many industrial, commercial, and household applications require the breaking up of relatively large objects into smaller pieces. The reduction process is variously referred to as cutting, chipping, shredding, mulching or grinding, depending in part on the size of the end product. Cutting and chipping is historically accomplished by chippers using relatively few chipper knives mounted directly onto a rotating disc and a bed knife, and produces pieces ranging up to about ¾ to 1½ inches in size.

One of the major issues with respect to the design of such devices is maintenance. Maintenance and adjustment of chipper and bed knives can be extremely cumbersome. In many chippers, a team of two men is required to change the chipper knives, by working through holes in the side of the chipper body. Long feeler gages must be used to adjust the gap between the knife and bed knife.

Another issue is the design and maintenance of the feed rollers. Traditionally, dirt and trash is carried into the chipper with the in-feeding of the brush and wood. This dirt always falls into the lower feed roller. If not cleaned out, it will lock up the feed roller such that it cannot rotate.

To access these various components and areas, some manufacturers of the disk-style machines often hinge the upper half or quarter of the chipper body for the servicing of knives. Such machines include the Model 1230 Chipper manufactured by Vermeer and the Model 90 Brush Bandit manufactured by Bandit. However, the bed knife remains difficult to adjust. Some other manufacturers such as Carlenburg for Mittsonmurrel Drum Machines and Gravely Disk Chippers enable the servicing of knives by hinging the feed hopper or sliding the upper feed roller vertically in a slide with weights or spring down pressure. In many of these systems, replacement of the feed rollers requires one to crawl inside the machine and awkwardly perform the replacement. Morey, U.S Pat. No. 5,005,620 discloses an upper feed roller pivoted from the chipper drum center-line (called the pivoted down stream). Houston, U.S. Pat. No. 4,390,132 discloses a trailing arm that is pivoted from a point above the feed path. A hydraulic cylinder and compression spring force engagement with the tree (feed stock). To reduce the frequency of required access, most manufacturers of chippers with lower feed rollers simply place an auxiliary frame or compartment that traps the dirt and debris.

SUMMARY OF THE INVENTION

The present invention is directed, in a first aspect, to a disc-type chipper in which easy and ready access to frequently maintained areas of the chipper are enabled or made unnecessary in a novel fashion. According to the preferred embodiment, both the chipper's upper-body (to change the disks, fan blades or knife holders) and the feed hopper (to service knives and adjust the bed knife) are hinged. The chipper body is hinged horizontally to open vertically and the feed hopper is hinged vertically to open to the side. The result is that one man can change knives and adjust the bed knife in several minutes with both feet on the ground.

Moreover, dirt or trash carried into the feed hopper and into the feed roller housing flows through and then exits into the chipper body with the wood chips. The fan blades in the chipper design advantageously actually vacuum clean the feed roller housing.

The present invention is also directed, in another aspect, to a novel feed roller design in which the feed roll teeth bite into the in-feed wood stock without the need for springs or weights to maintain traction. In the preferred embodiment, the upper feed roller is mounted with the pivot point being within the feed path and not above. An arm assembly to which the upper feed roller is attached has a pivot point which lies within the in-feed path, so that the roller trails behind and below the pivot point. This enables a ratchet action that naturally increases the bit down pressure on the in-feed wood. In another novel aspect, the upper feed roller with its sharp teeth is large enough to easily climb over the irregularities that exist in the feed wood. The lower feed roller is smaller in diameter and has low-profile cleats rather than teeth. Moreover, it is mounted as close as possible to the bed knife and chipper wheel. This design reduces the friction of the wood that passes through the in-feed hopper. Finally, in another novel aspect of the invention, each roller is powered with independent hydraulic motors with flow dividers to provide independent power to each roller in both the forward and reverse directions.

BRIEF DESCRIPTION OF THE DRAWINGS

These and other aspects of the present invention will become better understood through a consideration of the following description taken in conjunction with the drawings in which:

FIG. 7 is close-up perspective view of the preferred embodiment of the brush chipper according to the present invention where the in-feed hopper is hinged open.

FIG. 8 is close-up perspective view of the preferred embodiment of the brush chipper according to the present invention where the in-feed hopper is hinged closed.

DETAILED DESCRIPTION OF THE PREFERRED EMBODIMENT

Figure 1:
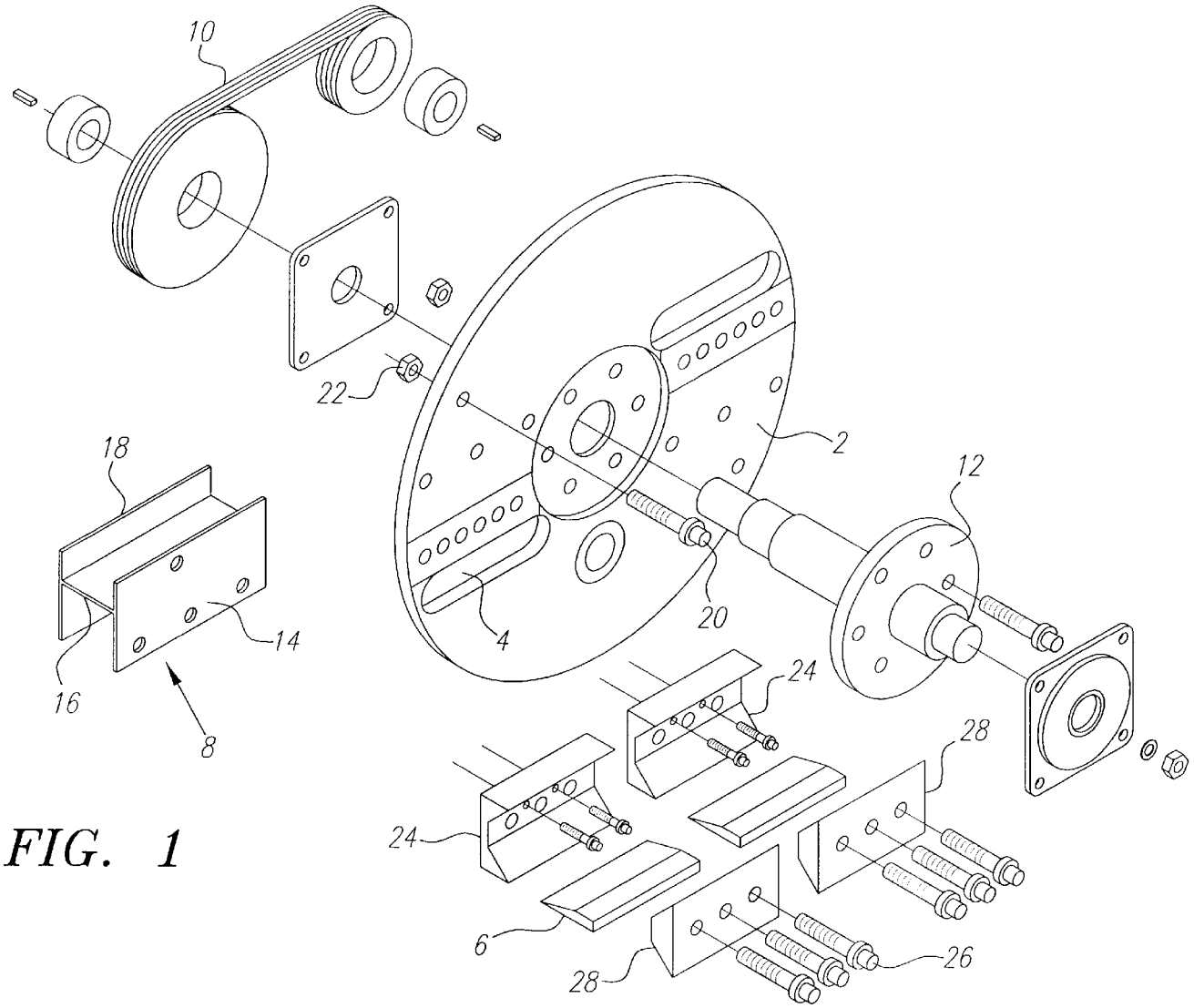
FIG. 1 is an exploded perspective view of the disc chipper and attachments according to the present invention.

FIG. 1 shows disc 2 with knife channels 4, and key knives 6, fan assemblies 8, and pulley belt drive 10 attached to disc 2. Disc 2 is about 39" in diameter, 1½" thick, comprised of A-36 steel, and is made to rotate about axle 12 at about 2000 rpm by a motor (not shown) attached to pulley belt drive 10. Knife channels 4 communicate across disc 2, thereby permitting chips and debris to pass through the disc 2 and out of a discharge tube 76. (See FIG. 5.)

The fan assemblies 8 shown in FIG. 1 comprise a base 14, a fan blade 16 and a fence 18. Bases 14 are attached to disc 2 with bolts 20 and lock nuts 22. Each of the fan assemblies 8 is attached to disc 2 through one of the bases 14 and is preferably oriented approximately twelve degrees off radial with respect to axle 12 to encourage radial air flow. The fences 18 assist in holding air and light material to fan blades 16 and further encourage radial airflow. The preferred embodiment has two fan assemblies 8, but fewer or greater number of fan assemblies 8 can also be accommodated.

Figure 2:
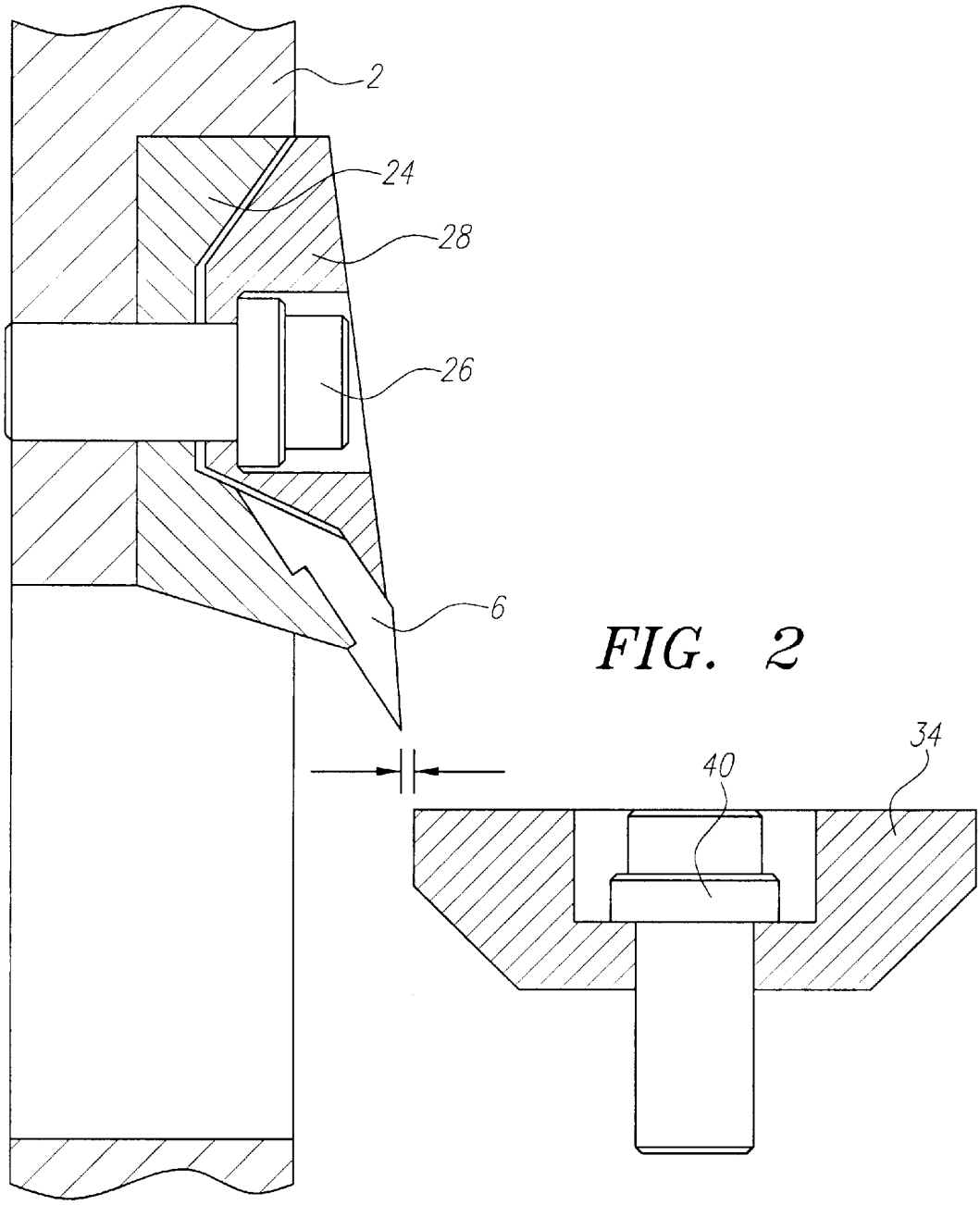
FIG. 2 is a close-up side view of the key knife subassembly attached to the disc of FIG. 1.

In FIGS. 1 and 2, key knives 6 are positioned as an assembly of components on disc 2. Each key knife 6 can have two cutting edges and is therefore reversible. Each key knife 6 is made expendable such that once both edges are dulled, it is easily replaced. Key knives 6 are preferably distanced away from the disc 2 by holders 24, and are attached to both disc 2 and holders 24 by bolts 26 and clamps 28. Thus, the key knives 6 are effectively positioned on a side of disc 2 even though they may not physically be touching disc 2. By spacing the key knife 6 away from the disc 2, the key knife 6 angle can be changed or adjusted, and the key knife 6 can be positioned closer to or farther away from the disc 2. Moreover, each of the key knife holders 24 has an underside key to enable accurate positioning of the key knives 6.

Figure 3:
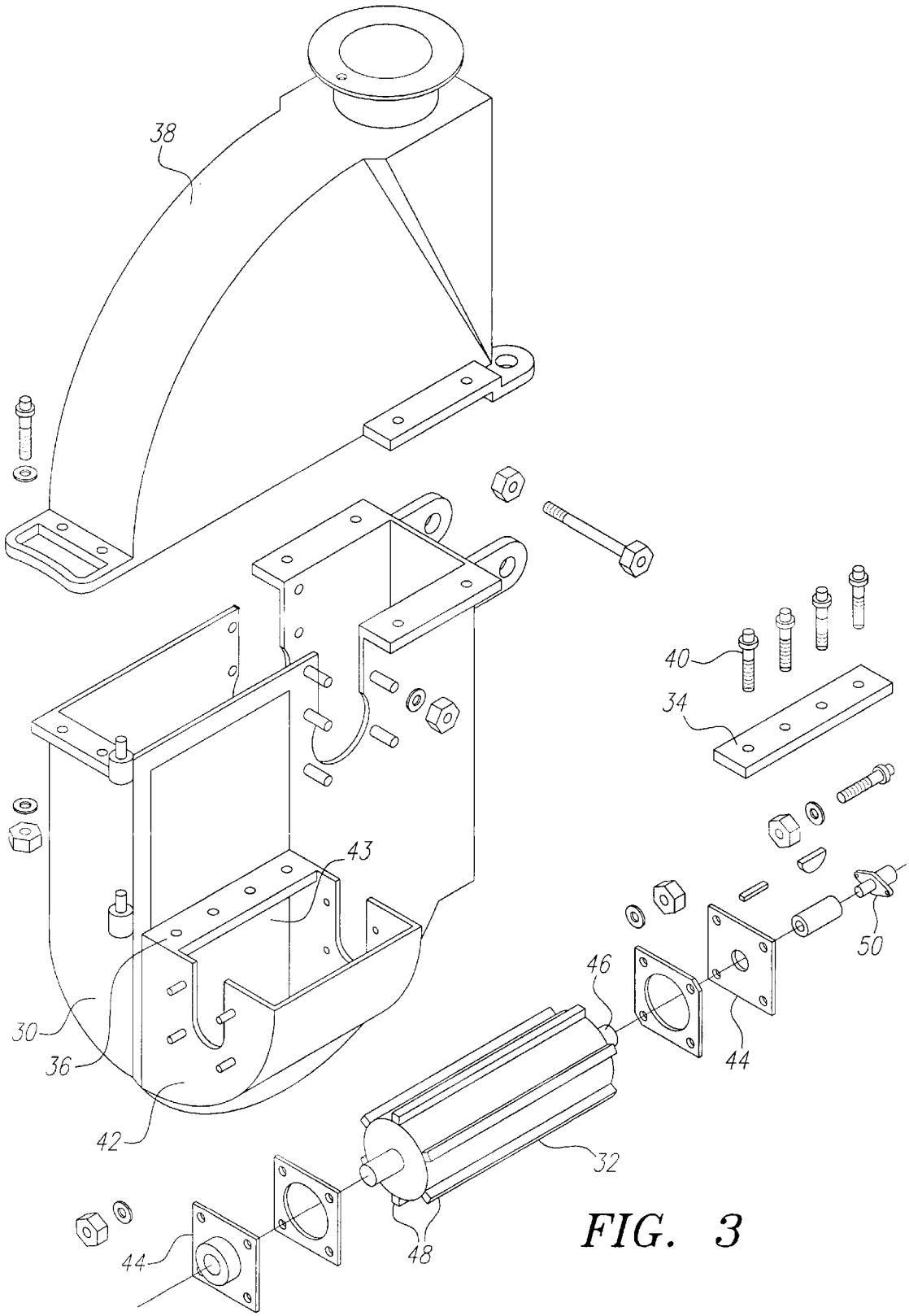
FIG. 3 is an exploded view of the chipper assembly according to the present invention.

FIG. 3 shows the outer assembly for the disc 2, including the housing for the disc 2, and attached lower feed roller 32, and bed knife 34. The housing is constructed in two sections, a cover weldment 38 and a body weldment 30. Integrated into the body weldment 30 is a bed knife holder 36. The bed knife 34 is then secured to the holder 36 with bolts 40 as shown in both FIGS. 2 and 3. The bed knife 34 is adjusted to have a 0.090-inch gap between it 34 and the closest key knife 6 on the disc 2. Integral to the body weldment 30 is a lower feed roller chamber 42. During rotation of the disc 2, the fan blades 8 of the disc 2 vacuum trash and debris into the disc housing section of the body weldment 30 that enters the lower feed roller chamber 42. Because of the integrated design of the body weldment 30 and the lower feed roller chamber 42, this vacuuming of the lower feed roller chamber 42 can take place through the opening 43 in the disc housing.

The lower feed roller 32 reduces the friction of the incoming debris. The debris then passes through the opening 43 in the disc housing to be blown out of the discharge tube 76 (See FIG. 5) by the fan blades 8 on the revolving disc 2. The lower feed roller 32 is held in place by bearings 44 attached to the lower feed roller chamber 42. The lower feed roller 32 has an 8-inch diameter and is 14 inches wide. A 1½ inches diameter shaft 46 extending beyond the lower feed roller's 32 width and providing the bearings' 44 point of support and rotation for the lower feed roller 32, is integrated with the roller 32 itself. The lower feed roller 32 is thereby supported within the chamber 42 for rotation about a generally horizontal axis. The lower feed roller 32 additionally has rows of low profile cleats 48 running along its width. Moreover, the lower feed roller 32 is mounted close to the bed knife 34 and disc 2. Finally, lower feed roller is powered by a 16 cubic inch at 6,329 in.-lbs. torque hydraulic motor 50 allowing for reverse or forward rotation.

Figure 4:
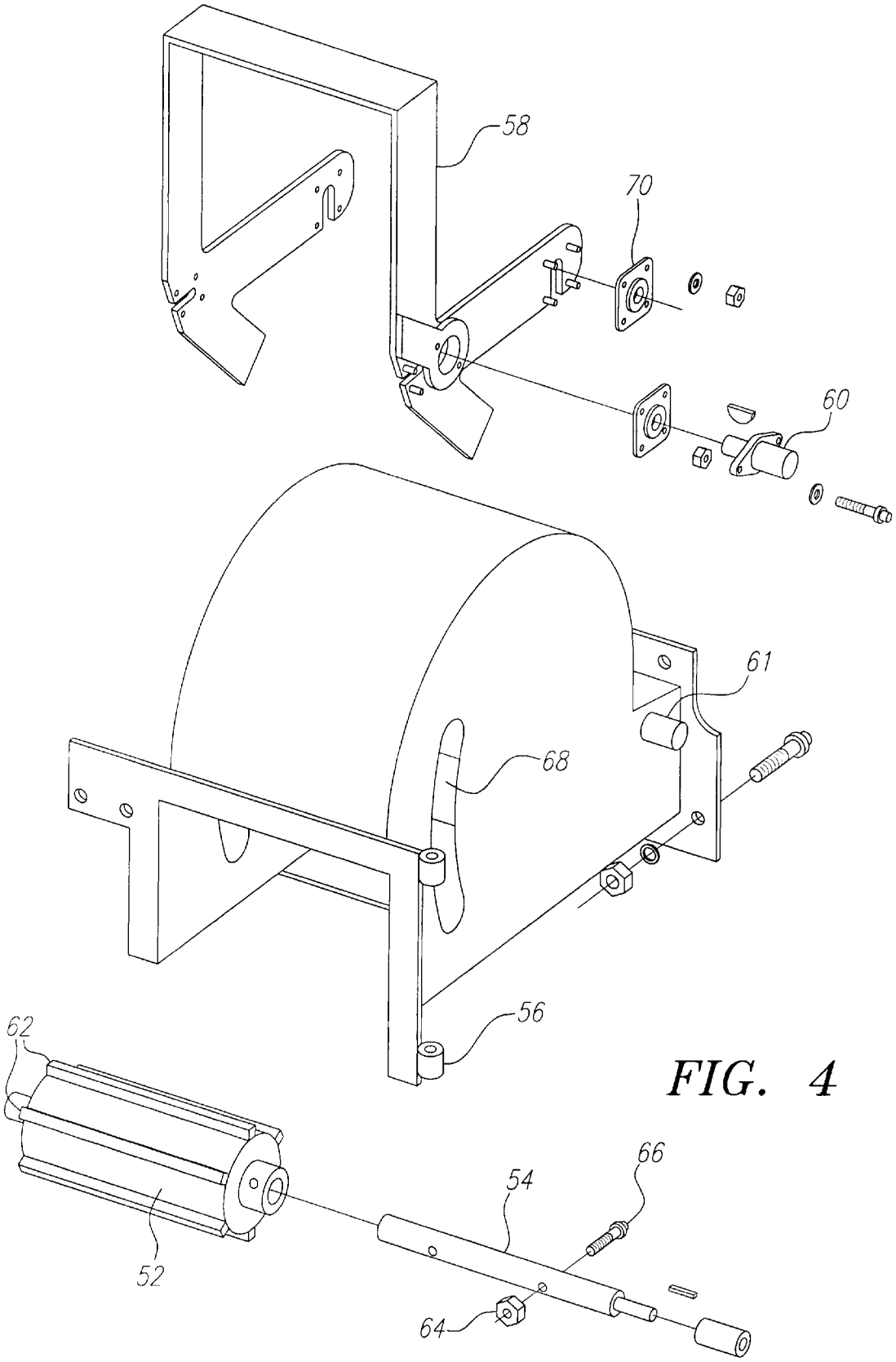
FIG. 4 is an exploded perspective view of the upper feed roll assembly according to the present invention.

FIG. 4 shows the assembly for the upper feed roller 52. The upper and lower feed rollers 52, 32 receive the input material from the in-feed hopper 72. (See FIG. 5.) The assembly includes an upper feed roller 52, upper feed roller shaft 54, upper feed roll weldment 56, trailing arms assembly 58, and hydraulic motor 60. The upper feed roller 52 is positioned above the lower feed roller 32 and is rotatably supported by the trailing arm assembly 58. The pivot points 61 for the upper feed roller 52 on the arm assembly 58 are on the sides of the weldment 56. Bearings 70 provide support to the trailing arm assembly 58 allowing for pivoting of the assembly 58 and upper feed roller 52. The arms' length of the trailing arm assembly 58 and its pivot point 61 is positioned so as to ensure a ratchet-type action when the roller 52 is in operation. This ratchet-type action naturally increases the bite down pressure on in-feeding wood and debris. The upper feed roller 52 has the same 14-inch width as the lower feed roller 32, but has a diameter of 12 inches. Rather than cleats 48, the upper feed roller 52 has ten sharpened blades 54, each having the same width as the roller 52 itself. The shaft 54 of the upper feed roller 52 has a length that exceeds the width of the upper feed roller 52. The shaft 54 runs through the center of the upper feed roller 52, and is attached to the upper feed roller 52 with nuts 64 and bolts 66. The upper feed roll weldment 56 covers the upper feed roller 52 and provides a track 68 for movement of the upper feed roller 52 caused by the pivoting of the trailing arms assembly 58. The upper feed roller 52 is independently powered by a 28 cubic inch at 11,269 in.-lbs. torque hydraulic motor 60 allowing for forward or reverse rotation.

Figure 5:
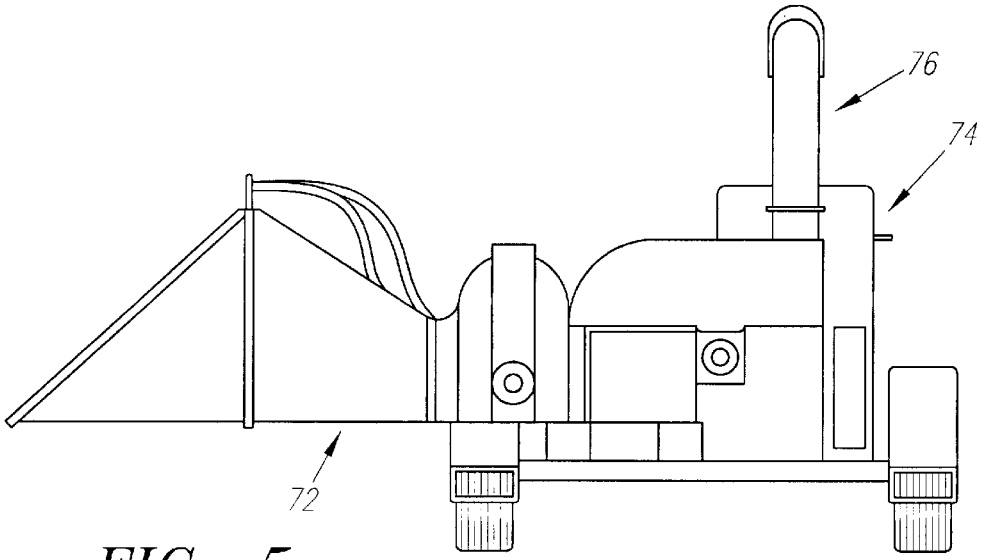
FIG. 5 is an side view of the preferred embodiment of the brush chipper according to the present invention where the in-feed hopper is hinged open and upper chipper body is hinged closed.
Figure 6:
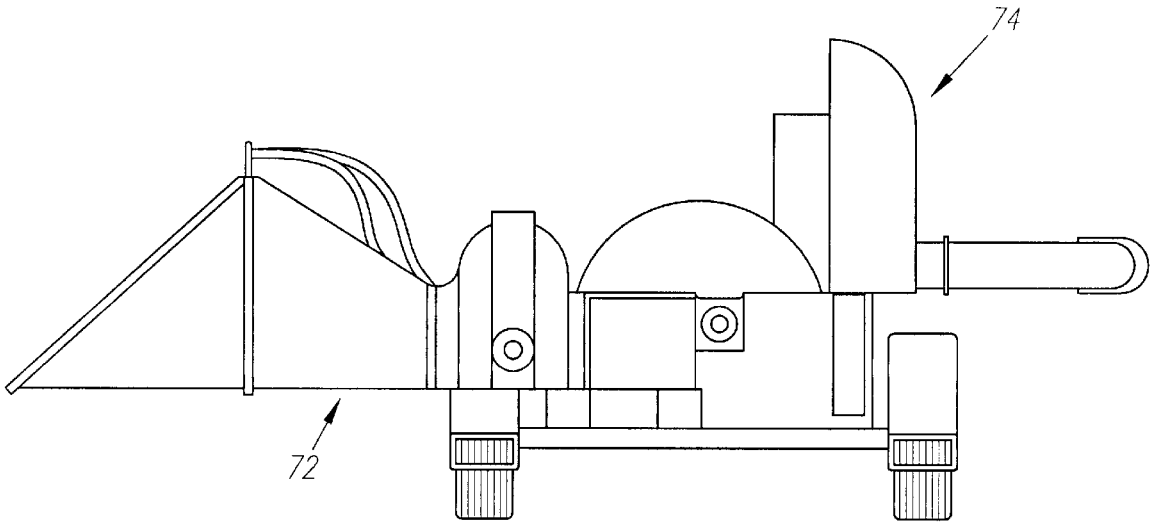
FIG. 6 is a side view of the preferred embodiment of the brush chipper according to the present invention where the in-feed hopper and upper chipper body are hinged open.

FIG. 5 shows a side view drawing of the brush chipper with the in-feed hopper 72 hinged open and the upper chipper body 74 hinged closed. FIG. 6 has the same perspective view as FIG. 5 except that the upper chipper body 74 is hinged open. Hinging of the upper chipper body 74 as shown in FIGS. 5 and 6 enables easy access to the disc 2, thus simplifying the tasks of replacing the disc 2, fan blades 8 or knife holders 24.

FIG. 7 is a close up perspective view of the brush chipper, including the upper feed roller 52, bed knife 34 and key knives 6. In this position, the in-feed hopper 72 is hinged open. In this position, the key knives 6 and bed knife 34 are easily accessed for adjustment or replacement. FIG. 8 shows same view of the brush chipper with the in-feed hopper 72 hinged closed to enable brush chipper operation.

While specific embodiments of this invention have been disclosed and described, it would be apparent to those skilled in the art that the invention can be modified in arrangement and detail without departing from such principles. As such it should be recognized that the detailed embodiment is illustrative only and should not be taken as limiting the scope of our invention. Rather we claim as our invention all such embodiments as may fall within the scope and spirit of the following claims and equivalents thereto.

I claim:

1. A brush chipper for chipping an object, the chipper comprising:

a lower feed roller partly inside a lower feed roller chamber;

an upper feed roller spaced apart from the lower feed roller;

a chipper housing for receiving the object from the rollers;

a disc inside the chipper housing, the disc having a knife for chipping the object into chips; and a fan assembly on the disc, the fan assembly including a fence.

2. The brush chipper according to claim 1, wherein the lower feed roller chamber has an opening to the chipper housing.

3. The brush chipper according to claim 1, wherein the diameter of the upper feed roller is greater than the diameter of the lower feed roller.

4. The brush chipper according to claim 1, wherein the upper feed roller has teeth and the lower feed roller has cleats.

5. The brush chipper according to claim 1, wherein the upper feed roller and lower feed roller are powered independently and in either the forward or reverse directions.

6. The brush chipper according to claim 1, wherein the chipper housing has a top portion, wherein the upper feed roller swings horizontally from the chipper housing, and wherein the top portion of the chipper housing swings vertically.

7. The brush chipper according to claim 1, further comprising:

an upper feed roller chamber, wherein the upper feed roller is partly inside the upper feed roller chamber; and an arm being pivotally attached at a pivot point to the upper feed roller chamber at one end and the arm being attached to the upper feed roller at the other end, wherein the object travels below the upper feed roller and the pivot point is within the path of the object.

8. The brush chipper according to claim 1, wherein the fan assembly further includes a fan blade.

9. A brush chipper for chipping an object, the chipper comprising:

an upper feed roller partly inside an upper feed roller chamber;

an arm being pivotally attached at a pivot point to the upper feed roller chamber at one end and the arm being attached to the upper feed roller at the other end;

a lower feed roller spaced apart from the upper feed roller defining a feed path therebetween for the object;

a chipper housing for receiving the object from the rollers; and a disc inside the chipper housing, the disc having a knife for chipping the object; wherein the pivot point is fixed within the feed path.

10. The brush chipper according to claim 9, further comprising a lower feed roller chamber attached to the chipper housing, wherein the lower feed roller is partly inside the lower feed roller chamber, and wherein the chamber has an opening to the chipper housing.

11. The brush chipper according to claim 9, wherein the diameter of the upper feed roller is greater than the diameter of the lower feed roller.

12. The brush chipper according to claim 9, wherein the upper feed roller has teeth and the lower feed roller has cleats.

13. The brush chipper according to claim 9, wherein the upper feed roller and lower feed roller are powered independently and in either the forward or reverse directions.

14. The brush chipper according to claim 9, wherein the chipper housing has a top portion, wherein the upper feed roller swings horizontally from the chipper housing, and wherein the top portion of the chipper housing swings vertically.

15. A brush chipper for chipping an object, the chipper comprising:

an upper feed roller;

a lower feed roller spaced apart from the upper feed roller defining a feed path therebetween for the object;

an arm pivotally attached at a fixed pivot point to the upper feed roller, the fixed pivot point being within the feed path; and a disc in the feed path and having a knife for chipping the object.

16. A brush chipper for chipping an object, the chipper comprising:

a lower feed roller partly inside a lower feed roller chamber;

an upper feed roller spaced apart from the lower feed roller;

a chipper housing for receiving the object from the rollers, the lower feed roller chamber having an opening to the chipper housing;

a disc inside the chipper housing, the disc having a knife for chipping the object into chips; and a fan assembly on the disc, the fan assembly vacuuming the chips collected in the lower feed roller chamber.

17. The brush chipper according to claim 16, further comprising:

an upper feed roller chamber, wherein the upper feed roller is partly inside the upper feed roller chamber; and an arm being pivotally attached at a pivot point to the upper feed roller chamber at one end and the arm being attached to the upper feed roller at the other end, wherein the object travels below the upper feed roller and the pivot point is within the path of the object.

18. A brush chipper for chipping an object, the chipper comprising:

an upper feed roller partly inside an upper feed roller chamber;

an arm being pivotally attached at a pivot point to the upper feed roller chamber at one end and the arm being attached to the upper feed roller at the other end;

a lower feed roller spaced apart from the upper feed roller, the lower feed roller being partly inside a lower feed roller chamber;

a chipper housing for receiving the object from the rollers, the lower feed roller chamber being attached to the chipper housing;

a disc inside the chipper housing, the disc having a knife for chipping the object;

wherein the object travels below the upper feed roller to reach a space below the pivot point, and wherein the chamber has an opening to the chipper housing.

* * * * *